10/22/85 XR 4,548,353

United States Patent [19]

Howard et al.

[11] Patent Number: 4,548,353

[45] Date of Patent: Oct. 22, 1985

[54] CASH DROP BOX HAVING A PLURALITY OF COMPARTMENTS

[76] Inventors: Robert Howard, 73 Estates Ter. North, Manhasset, N.Y. 11030; Jerry Knoll, 628 W. White Horse Pike, Cologne, N.J. 08213

[21] Appl. No.: 570,841

[22] Filed: Jan. 16, 1984

[51] Int. Cl.[4] ..... A47G 29/00

[52] U.S. Cl. ..... 232/4 R; 232/43.2; 109/48

[58] Field of Search ..... 232/4 R, 6, 12, 43.1, 232/43.2, 43.5; 109/48, 53

[56] References Cited

U.S. PATENT DOCUMENTS

| | | | |
|---|---|---|---|
| 1,325,197 | 12/1919 | Gregorovius | 232/4 R |
| 2,686,007 | 8/1954 | Hurtig et al. | 232/4 R |
| 4,452,390 | 6/1984 | West | 232/43.2 X |

FOREIGN PATENT DOCUMENTS

| | | | |
|---|---|---|---|
| 2829532 | 10/1979 | Fed. Rep. of Germany | 109/48 |

*Primary Examiner*—Robert P. Swiatek
*Attorney, Agent, or Firm*—Louis Weinstein

[57] ABSTRACT

A drum-shaped cash drop box rotatable about a pin coincident with its central axis includes a substantially U-shaped rotatable handle. The drum has a plurality of compartments. Insertion slots arranged at spaced intervals about the drum cylindrical periphery, each communicating with an associated compartment. Swingable doors arranged along one flat side wall of the drum respectively lockingly seal and unseal access openings, for gaining access to the compartments. The drop box is insertable into a parallelepiped shaped sleeve, having one vertical side opening. Guides in the sleeve interior limit the penetration depth of the drop box into the sleeve and align the handle for locking. The pin of a lockable detent moves into an opening in one arm of the handle to lock the drop box within the sleeve while permitting free rotation thereof. The top surface of the sleeve is provided with a common insertion opening and the drop box is rotatable to selectively align the drop box insertion openings therewith. Shutter assemblies provided in each compartment include a shutter biased to seal its associated insertion opening. A latch assembly receives a projection on its associated shutter plate to lock the shutter plate in a position displaced from the associated insertion opening. A lockable detent mounted upon the sleeve includes a pin movable through an elongated opening in the sleeve for unlatching the latch assembly, the shutter being held in the latched position by the pin until release.

27 Claims, 12 Drawing Figures

FIG. 1
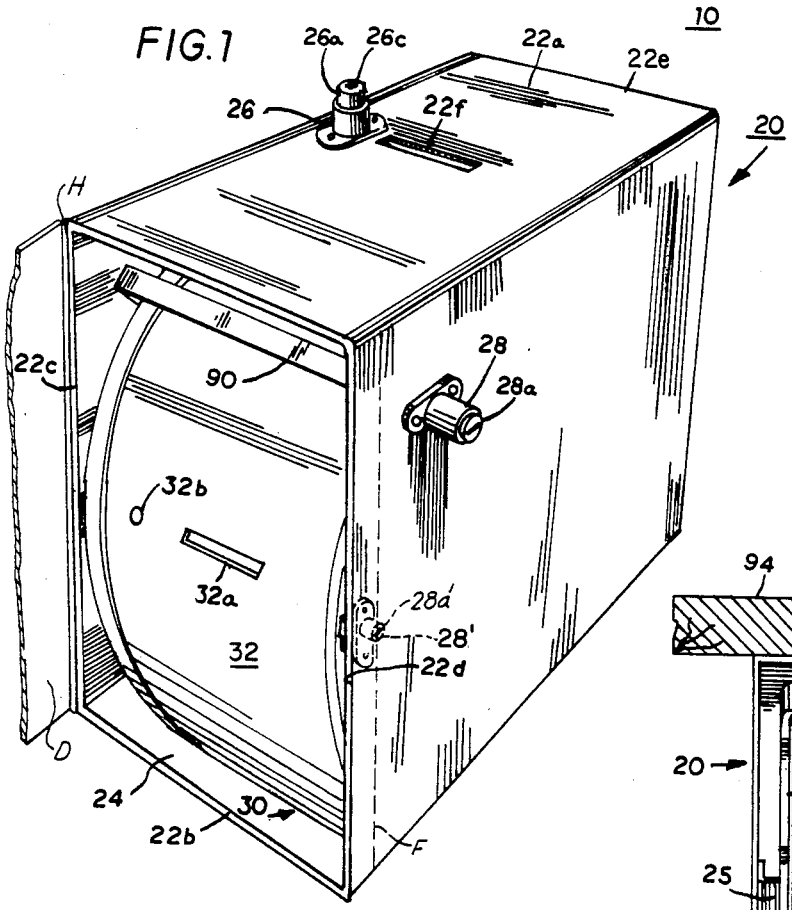
FIG. 1a
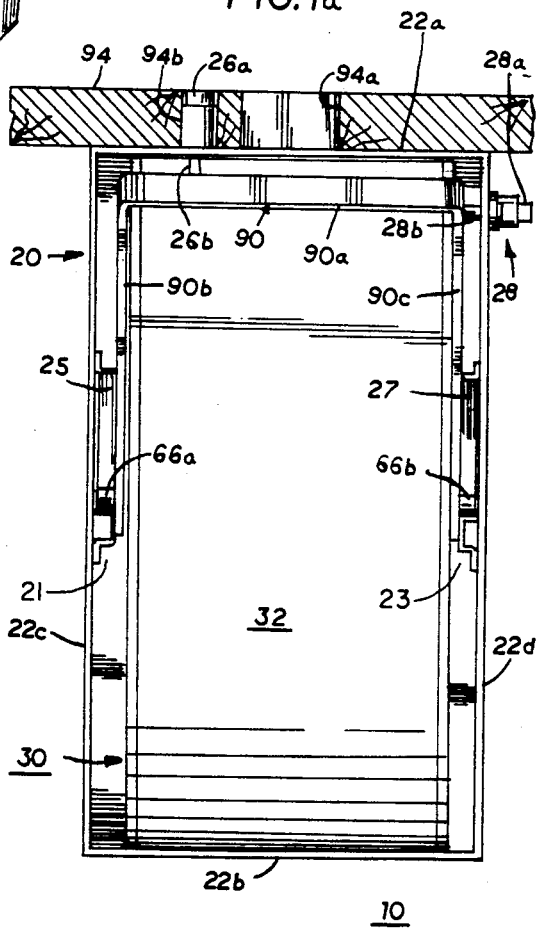
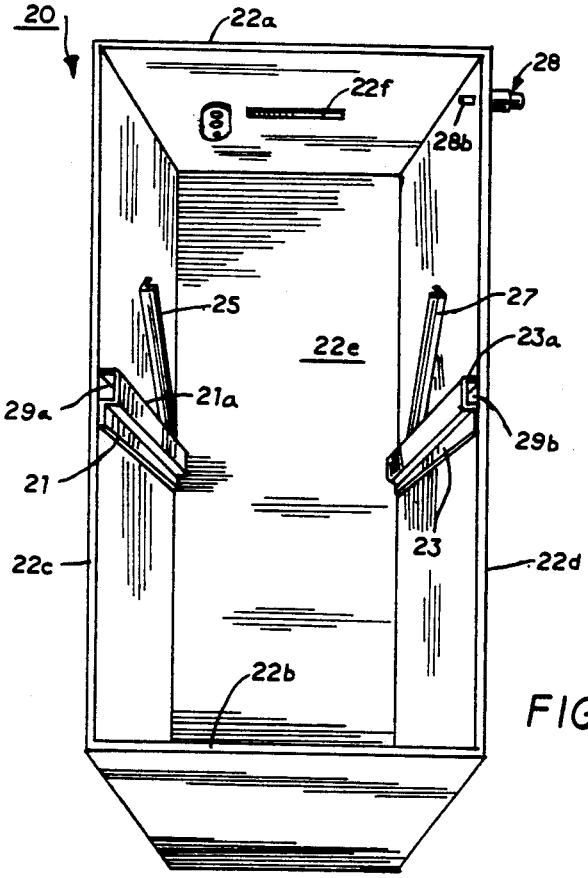
FIG. 1b

CASH DROP BOX HAVING A PLURALITY OF COMPARTMENTS

FIELD OF THE INVENTION

The present invention relates to drop boxes, and more particularly, to a novel multi-compartment drop box having N compartments, thus requiring removal of the drop box from its operative position 1/Nth as often as conventional drop boxes.

BACKGROUND OF THE INVENTION

Drop boxes are typically utilized in applications in which it is desired to temporarily and securely store paper currency. For example, drop boxes are typically employed in gaming casinos and are positioned beneath a gaming table, which is provided with an opening aligned with a like opening in the drop box which is releasably secured to the underside of the table. The paper currency is deposited in the drop box by placing the paper currency over the table insertion slot and pressing the paper currency into the table and drop box insertion slots by means of an insertion blade. The drop box is removed from beneath the table at regular, periodic intervals, the drop box insertion slot being sealed upon its removal from the table.

It is typical to provide a separate drop box for each shift during which the table is operated. Thus, in applications where there are two or three shifts per twenty-four hour period, it is necessary to provide at least three drop boxes per table, and to change the drop boxes two or three times during each twenty-four hour period. Drop boxes are typically removed to a counting room, where their contents are counted, necessitating two or three separate counting operations.

BRIEF DESCRIPTION OF THE INVENTION

It is, therefore, an object of the present invention to provide an improved drop box assembly, which overcomes the complexity, tediousness and expense associated with the use of conventional drop boxes.

The present invention is characterized by comprising a hollow drum-shaped drop box divided into a plurality of equal size compartments, preferably three in number. A pin extends through the longitudinal axis of said cylindrical-shaped drop box and the free ends thereof extend beyond the substantially flat sides of the drop box for receiving and supporting the free ends of the arms of a substantially U-shaped handle, which is rotatable relative to the drop box and which facilitates transportation of the drop box and placement into its operative position.

The cylindrical periphery of the drop box is provided with a plurality of insertion openings arranged at equispaced intervals, each opening being associated with one of said compartments. The drop box is insertable into a rectangular parallelepiped-shaped sleeve, having one vertical side open for receiving the drop box and provided with guide means along opposite interior side walls for limiting the penetration depth of the drop box into the sleeve and for rotatably supporting the drop box therein.

A first lock is arranged along one vertical side wall of the sleeve and includes a movable pin for insertion into an opening in the handle to lock the drop box into the operative position in said sleeve, while freely permitting rotation of the drop box.

The drop box is rotated while in the sleeve to move one of the insertion openings into alignment with the common insertion opening in said sleeve, at which time, the pushbutton of lockable detent means mounted on the top surface of said sleeve is depressed, causing a detent pin to pass through an elongated opening in the shutter plate of a shutter assembly provided in the associated compartment, whose insertion opening is aligned with the sleeve common insertion opening, to thereby release latch means latching the shutter plate in a position displaced from the compartment insertion opening. Although the shutter plate undergoes slight movement, the detent pin prevents the shutter plate from sealing its associated insertion opening. Thus, the insertion opening in one of said compartments is accessible for receiving paper currency during the present shift. Upon the end of the last-mentioned shift, the lockable detent means is unlocked, removing the pin from the elongated opening inside the shutter plate, causing the shutter plate to snap shut and seal its associated insertion opening thus securing the contents. The drop box is then rotated to move the insertion opening for the compartment associated with the next shift into alignment with the sleeve common insertion opening. The lockable detent means is again operated in a manner similar to that previously described for the second, and ultimately, for the third shift.

Upon completion of three successive shifts, the drop box, with all of the shutter assemblies sealing their insertion opening, is removed from said sleeve by unlocking the lock means whose pin extends throught the opening in said handle and removing the drop box from the sleeve and transporting it, preferably by said handle, to the counting room.

Each drop box compartment is provided with a lockable door for gaining access to the contents of its associated compartment. Thus, the paper currency taken in during each shift may be simply and accurately counted and allocated to its respective shift. In addition, the novel drop box of the present invention reduces the required number of insertions and removals of the drop box from each gaming table by one third, and reduces the number of counting operations required during each day by one third, thus providing significant reductions in operating costs and the time required to perform drop box changing operations and counting operations.

OBJECTS OF THE INVENTION AND BRIEF DESCRIPTION OF THE FIGURES

It is, therefore, one object of the present invention to provide a novel drop box having a plurality of compartments and rotatable to align each of said compartments with the table insertion slot, each of said compartments being associated with a discreet operating shift.

Still another object of the present invention is to provide a novel drop box having a plurality of compartments, each having an insertion slot for receiving currency and the like, said drop box being adapted for releasable mounting within a sleeve and rotatable therein to selectively enable each of the compartments to receive currency during a predetermined operating period.

Still another object of the present invention is to provide a novel drop box assembly of the character described, in which each of the compartments thereof is provided with a novel shutter assembly displaced from the compartment's insertion opening releasable latch means during use, and which shutter assembly automatically seals the insertion opening when the drop box is rotated to its next position and/or is removed from the sleeve in which the drop box is mounted.

The above, as well as other objects of the present invention will become apparent when reading the accompanying description and drawings in which:

FIG. 1 is a perspective view showing the novel sleeve and drop box of the present invention and showing the drop box mounted in said sleeve.

FIG. 1*a* shows a perspective view of the sleeve and drop box of FIG. 1 mounted beneath a table.

FIG. 1*b* shows an internal perspective view of the sleeve of FIG. 1 with the drop box removed.

FIG. 1*c* is a detailed perspective view showing the manner in which the drop box handle is locked in the sleeve.

FIGS. 2*a* and 2*b* show perspective views of the drop box and showing one door to an access opening in the open and closed position, respectively.

FIG. 3 is a sectional view showing the internal arrangement of the drop box of FIG. 2*a*.

FIG. 4*a* shows a perspective view of a shutter mechanism employed in each compartment of the drop box of FIG. 1.

FIG. 4*b* shows an exploded perspective view of the drop box shutter assembly.

FIG. 4*c* shows an elevational view of the releasable latch mechanism employed as part of the shutter assembly of FIG. 4.

DETAILED DESCRIPTION OF THE INVENTION

Figure 1E:
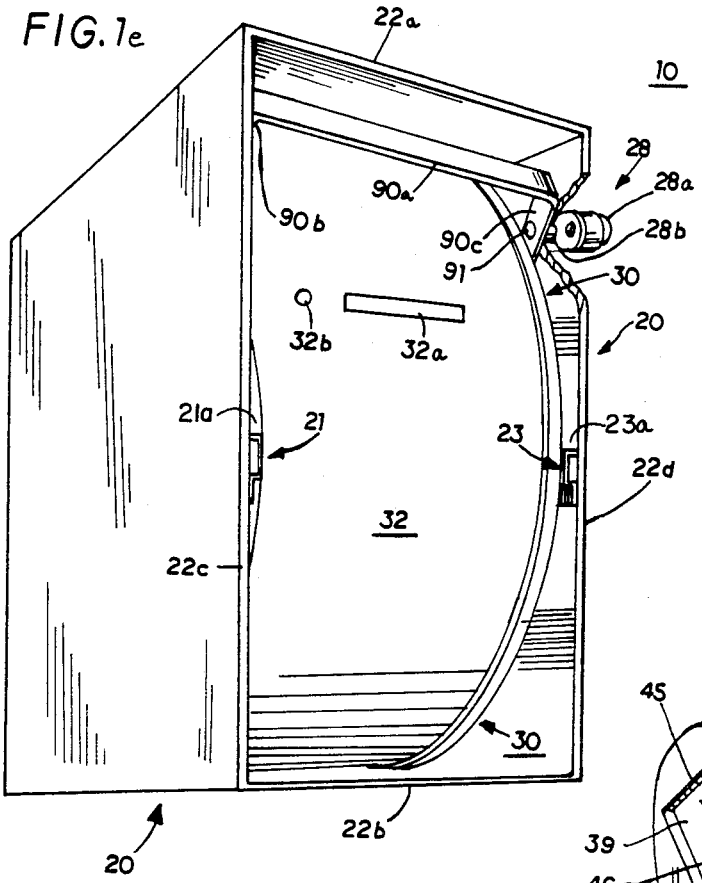

Considering FIGS. 1 through 1*c*, 2*a* and2*b*, there is shown therein a cash collection system 10 comprised of a sleeve assembly 20 and drop box 30.

Sleeve 20 has a substantially rectangular parallelepiped shape and is comprised of substantially continuous top and bottom surfaces 22*a*, 22*b*, left and right-hand side surfaces 22*c* and 22*d*, and rear surface 22*e*. The left-hand ends of top and bottom surfaces 22*a*, 22*b* and the left and right-hand side surfaces 22*c* and 22*d* define a rectangular-shaped opening 24 through which drop box 30 may be selectively inserted and removed. A door D may be swingably connected to sleeve 20 by a piano type hinge H. The free flange F of door D may be provided with a lock 28' similar to lock 28 and cooperating with an opening (not shown) in sidewall 22*d* to lock door D.

The top surface 22*a* of sleeve 20 is provided with an elongated common insertion slot 22*f* which cooperates with similar insertion slots (to be more fully described) provided in drop box 30 to facilitate selective insertion of paper currency into the desired drop box compartment.

A lock assembly 26 having a pushbutton 26*a* serves to retain the insertion opening of the desired compartment of drop box 30 in alignment with common insertion opening 22*f* in a manner to be more fully described.

Lock assembly 28 on side wall 22*d* is similarly provided with a pushbutton 28*a* and has a movable pin 28*b* whose movement is controlld by the lock and the pushbutton 28*a* is provided to lockably retain the drop box assembly 30 within the sleeve 20 in a manner to be more fully described.

The interior surfaces of walls 22*c* and 22*d* have mounted thereon supporting guide rails 21 and 23 for supporting the center pin of the drop box to facilitate insertion and removal of the drop box 30 into sleeve 20. A pair of elongated L-shaped limit rails 25 and 27 are secured to the interior surfaces of left and right-hand side walls 22*c* and 22*d* and cooperate with the supporting guide rails 21 and 23, respectively, to limit the depth of insertion of the drop box and further to positively locate the drop box handle 90 within sleeve 20 for locking purposes, as will be more fully described.

The exposed ends of support guide rails 21 and 23 are provided with indicia 29*a*, 29*b* in the form of "arrowheads" to facilitate alignment of the insertion opening of each drop box compartment with common insertion opening 22*f*, as will be more fully described.

Turning to a consideration of FIGS. 1, 1*a*, 1*c*, 2*a* and 2*b*, drop box 30 can be seen to have a substantially drum-shaped configuration comprised of a cylindrical portion 32 and two substantially planar end walls 34 and 36 permanently secured to the cylindrical portion 32, such as, for example, by welding.

Drop box 30, in the preferred embodiment, is provided with three separate compartments, a first form of access to each being by means of an insertion opening 32*a*. Since there are three compartments, it should be understood that three insertion openings are provided at equally spaced intervals about cylindrical portion 32, one for each compartment. A substantially circular opening 32*b* is provided alongside of each insertion opening 32*a* for receipt of the movable pin 26*b* of pushbutton type locking assembly 26, as will be more fully described, especially in connection with FIGS. 4*a* through 4*c*.

Each compartment within drop box 30 is also provided with an access opening, there being three such access openings 34*a* through 34*c* in side wall 34, each access opening being selectively sealed by an access door 35, 37, 39, each door being hingedly coupled to side wall 34 by means of a hinge assembly 41, 43 and 45 respectively, which hingedly join each door 35, 37, 39 to side wall 34 along one edge of each of the respective openings 34*a* through 34*c*.

Figure 2A:
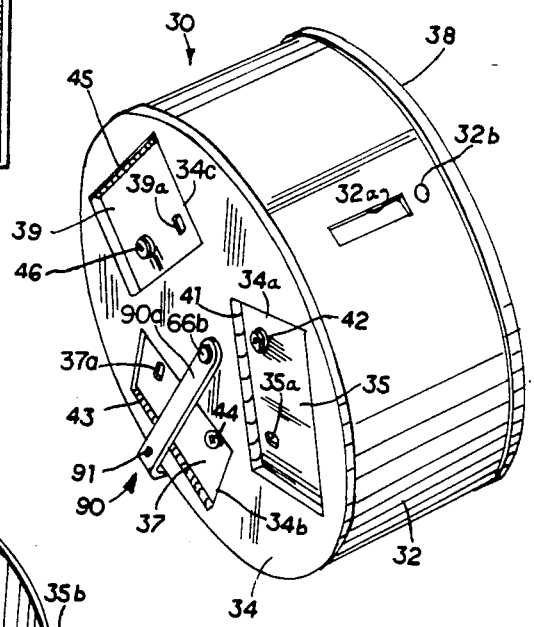
Figure 2B:
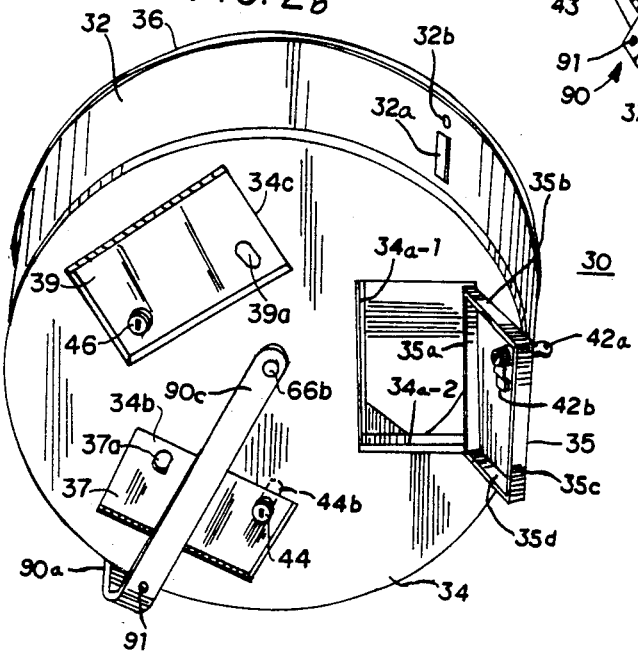

Each door 35, 37, 39 is provided with at least one lock 42, 44, 46 for retaining each door locked in the closed position during use of the drop box. Although not shown, it should be obvious that each lock assembly 42 through 46 may be operated by a suitable key such as, for example, the key 42*a* provided in lock 42 as shown in FIG. 2*b*. By manipulation of key 42*a*, the swingable locking member 42*b* may be moved to the unlocked position shown in FIG. 2*b* or to the locked position as shown in dotted fashion by the locking member 44*b* in FIG. 2*b*. Each opening 34*a* through 34*c* is provided with a marginal shoulder against which the side walls 35*a*–35*d* of door 35 rest, shoulders 34*a*-1 and 34*a*-2 being shown in FIG. 2*b*. Side walls 35*a*–35*d* and the aforementioned shoulders of opening 34 cooperate to positively define the closed position of door 35. By manipulating lock 42 to the locked position, door 35 is retained locked in the closed position.

Each of the doors 35, 37 and 39 is further provided with an opening 35*a* through 39*a* for mounting a second lock. When two locks are utilized per door, the preferred technique is that each lock be provided with a different key, each key being assigned to a different key holder, thus requiring the cooperation of two separate key holders in order to open each compartment.

Figure 3:
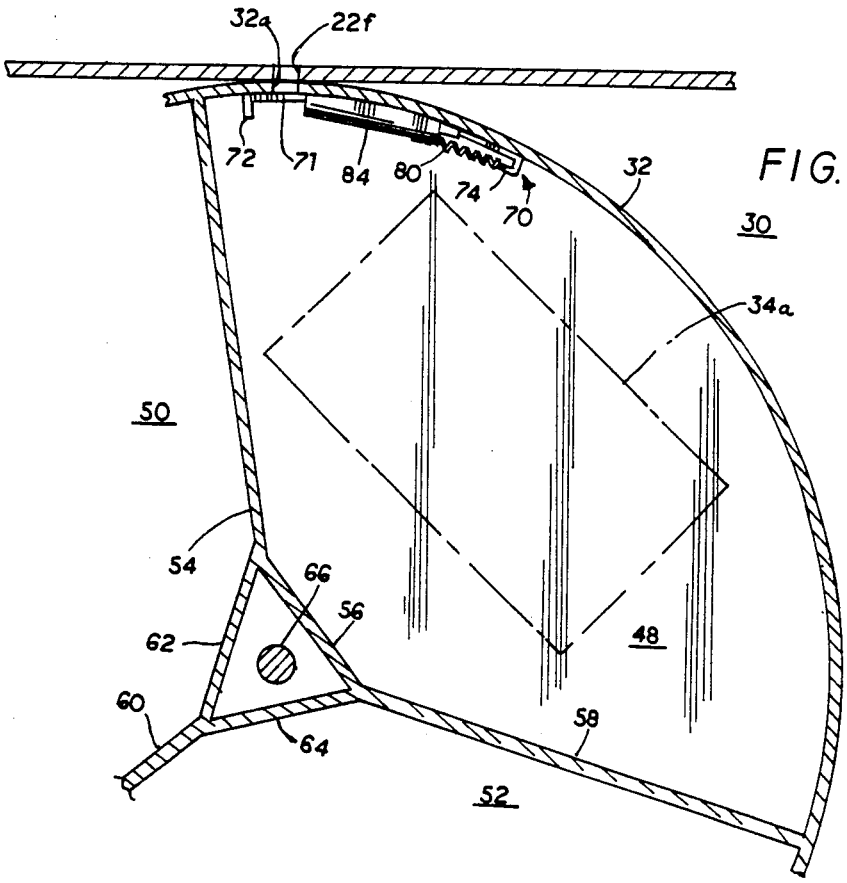

FIG. 3 shows one typical compartment within drop box 30. Compartment 48 is defined by a portion of the cylindrical wall 32 and barrier plates 54, 56 and 58. Barrier plate 54 separates compartment 48 from compartment 50, while barrier plate 58 separates compartment 48 from compartment 52. Barrier plates 54 and 58 form an angle of 120° in the preferred embodiment. The remaining barrier plate 60 separates compartment 50 from compartment 52. Barrier plates 56, 62 and 64 surround the central axis of drop box 30 through which pin 66 extends. The opening 34*a* for access door 35 has been superimposed upon FIG. 3 and shown in dotted fashion, it being understood that the opening of door 35 sealing opening 34*a* permits the operator to easily and readily remove the contents of compartment 48.

A shutter assembly 70 shown in compartment 48 serves to selectively seal compartment 48 in a manner to be more fully described.

Drop box 30 is further provided with a substantially U-shaped handle 90 shown best in FIGS. 1*a*, 1*c*, 2*a* and 2*b* and comprised of a central or yoke portion 90*a* and two arms 90*b* and 90*c* integrally joined to yoke portion 90*a*. The free ends of arms 90*b* and 90*c* are provided with suitable openings for receiving ends 66*a*, 66*b* of central pin 66 (note also FIG. 3). Handle 90 is free to rotate relative to the drop box 30 and serves as a convenient means for transporting drop box 30 simply by gripping yoke portion 90*a*. Arm 90*c* is provided with an opening 91 shown best in FIGS. 1*c*, 2*a* and 2*b*, opening 91 cooperating with pushbutton lock 28, to lock drop box 30 in the operative position within sleeve 20 in the following manner:

In order to place drop box 30 into sleeve 20, the drop box is inserted into open end 24 with the ends 66*a*, 66*b* of pin 66 being placed upon the supporting surfaces 21*a*, 23*a* respectively of support guides 21 and 23. The drop box 30 is then pushed into sleeve 20 with the ends 66*a*, 66*b* of pin 66 sliding along guide surfaces 21*a*, 23*a* respectively. Ultimately, ends 66*a*, 66*b* of pin 66 engage the bottom portions of L-shaped stop guides 25 and 27 which limit the depth of penetration of drop box 30 into sleeve 20. In this position, the drop box 30 is now fully and properly positioned within sleeve 20.

Handle 90 is then moved upwardly until its arms 90*b*, 90*c* abut against stop guides 25 and 27. At this time, the handle is now in the proper operative position and is locked in this position by pressing pushbutton 28*a* inwardly from the position shown in FIG. 1*a* to the locked position shown in FIG. 1. Pushing button 28*a* inwardly moves the pin 28*b* of pushbutton lock 28 to the left, causing pin 28*b* to enter into the opening 91 in handle arm 90*c*. Once the pushbutton 28*a* is fully depressed, it is self-locking in this position and cannot be released except by insertion of a key. The drop box 30 cannot be removed from sleeve 20, but nevertheless, is free to rotate relative to handle 90 and relative to sleeve 20.

As was mentioned hereinabove, the drop box 30, in the preferred embodiment, is provided with three separate compartments which lends itself advantageously for use in multi-shift cash handling activities such as those encountered in casinos, gaming establishments and the like.

Figure 5:
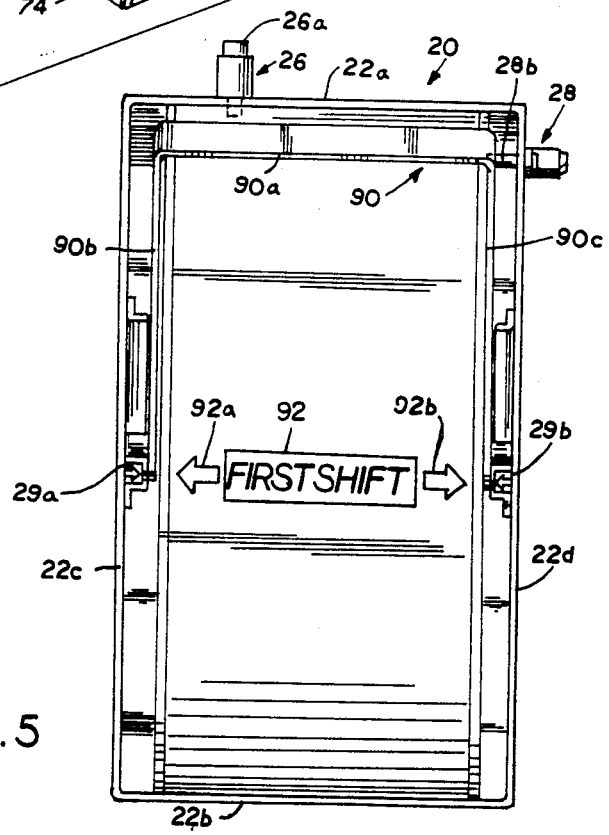
FIG. 5 shows an elevational view of the sleeve and drop box of FIG. 1 showing the cooperating positioning indicator employed for aligning the drop box within the sleeve.

The exterior surface of cylindrical portion 32 as shown, for example, in FIG. 5, is provided with identifying indicia 92 which includes the words "FIRST SHIFT" and a pair of arrows 92*a* and 92*b* which are provided for alignment with the arrowheads 29*a*, 29*b*.

In the preferred embodiment, each compartment 48, 50 and 52 is arbitrarily assigned to a particular operating shift, in many instances there being three such operating shifts per twenty-four hour period. Assuming that drop box 30 is inserted into sleeve 20 preparatory to initiation of the first shift, it is important to align the insertion opening 32*a* of the first shift compartment with the common insertion opening 22*f* in sleeve 20. As shown in FIG. 1*a*, sleeve 20 is preferably mounted to the underside of a table shown schematically in FIG. 1*a* as comprised of a table surface 94, having a common insertion slot 94*a* of a shape similar to insertion slots 22*f* and 32*a*. Table surface 94 is further provided with an opening 94*b* into which the upper portion of pushbutton lock assembly 26 including pushbutton 26*a* extends. Thus, the indicia 92 on the exterior surface of cylindrical wall 32 and cooperating indicia 29 and 29*b* are utilized to align the first shift compartment insertion opening with common insertion opening 22*f* in sleeve 22 and insertion opening 94*a* in table-top 94. This is accomplished by rotating drop box 30 until the aforesaid indicia are coaligned as shown best in FIG. 5. At this time, insertion opening 32*a* of compartment 48 will be immediately beneath insertion openings 22*f* and 94*a*. This alignment may be confirmed simply by looking through opening 94*a*. Upon such confirmation, pushbutton 26*a* is pressed downwardly where it is locked in the downward position. Pin 26*b* of pushbutton lock 26 moves downwardly through opening 32*b* in cylindrical side wall 32, and further activates the shutter assembly 70 in a manner to be more fully described hereinbelow. Since each compartment has a shutter assembly, only one will be described for purposes of simplicity.

Shutter assembly 70, as shown best in FIGS. 3, 4*a*, 4*b* and 4*c*, is comprised of a shutter plate 71 having a forward lip 72 arranged to one side of an elongated notch 73, and having a U-shaped rearward end 74. In the preferred embodiment, shutter plate 71 has a radius of curvature subtantially the same as the radius of curvature of cylindrical side wall 32. Shutter plate 71 is mounted for reciprocating slidable movement upon the interior of cylindrical wall 32 by means of curved stationary guide plates 75 and 76, having portions 75*a*, 76*a* secured to the interior surface of cylindrical side wall 32 such as by welding as shown by weldments 77, and having a second portion 75*b*, 76*b* spaced from the interior surface of cylindrical wall 32 sufficiently to form a curved guideway with wall 32 for slidably receiving and guiding shutter plate 71.

Shutter plate 71 is provided with a centrally located elongated opening 78. A projection 79 joined to the interior surface of cylindrical side wall 32 extends inwardly from said wall and through opening 78, and has secured thereto one end 80*a* of a spring 80 having a substantially large spring constant. The opposite end 80*b* of spring 80 is joined to U-shaped end 74 of shutter plate 71 and serves to normally urge shutter plate 71 in the direction shown by arrow 82, so that the central portion of shutter plate 71 immediately behind elongated notch 73 completely covers and seals insertion opening 32*a*. Movement of shutter plate 71 in the direction of arrow 82 is limited by U-shaped end 74 engaging the adjacent ends of guide plates 75, 76.

The shutter assembly 70 further includes a latch assembly 83 incorporating an elongated support bracket 84 having a substantially U-shaped configuration, the yoke portion 84a having integrally joined thereto downwardly depending arms 84b and 84c. Arm 84b is longer than arm 84c and is further provided with an outwardly extending integral flange 84d which is joined to the interior surface of cylindrical side wall 32. The hollow interior portion of mounting bracket 84 embraces guide member 76, while the free edge of arm 84c is spaced from the confronting surface of shutter member 71 to provide a clearance gap sufficient to permit shutter member 71 to freely move in its reciprocating fashion beneath bracket 84.

A latch arm 85 is pivotally mounted to the exterior surface of arm 84c by pin 86 and is provided with a notch 85a which cooperates with the lip 72 provided at the forward end of shutter plate 71 in a manner to be more fully described.

An elongated leaf spring 87 preferably formed of a spring steel material is arranged on the top surface of yoke 84a and is joined to one end of the yoke portion 84a of bracket 84 by a pair of fastening members 88. Leaf spring member 87 extends over the side of yoke portion 84b to which arm 85 is integrally joined so as to bear against the upper edge 85b of latch arm 85 and normally urge latch arm 85 in the direction shown by arrow 89 about its pivot pin 86.

Figure 4A:
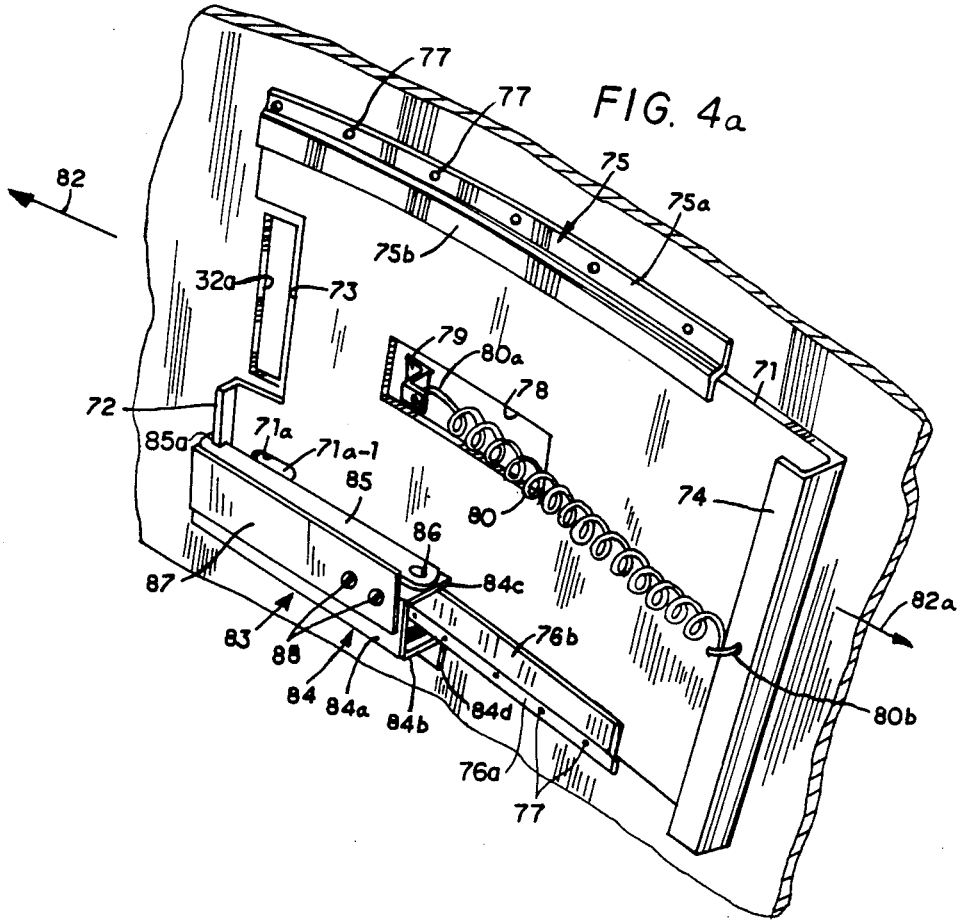
Figure 4B:
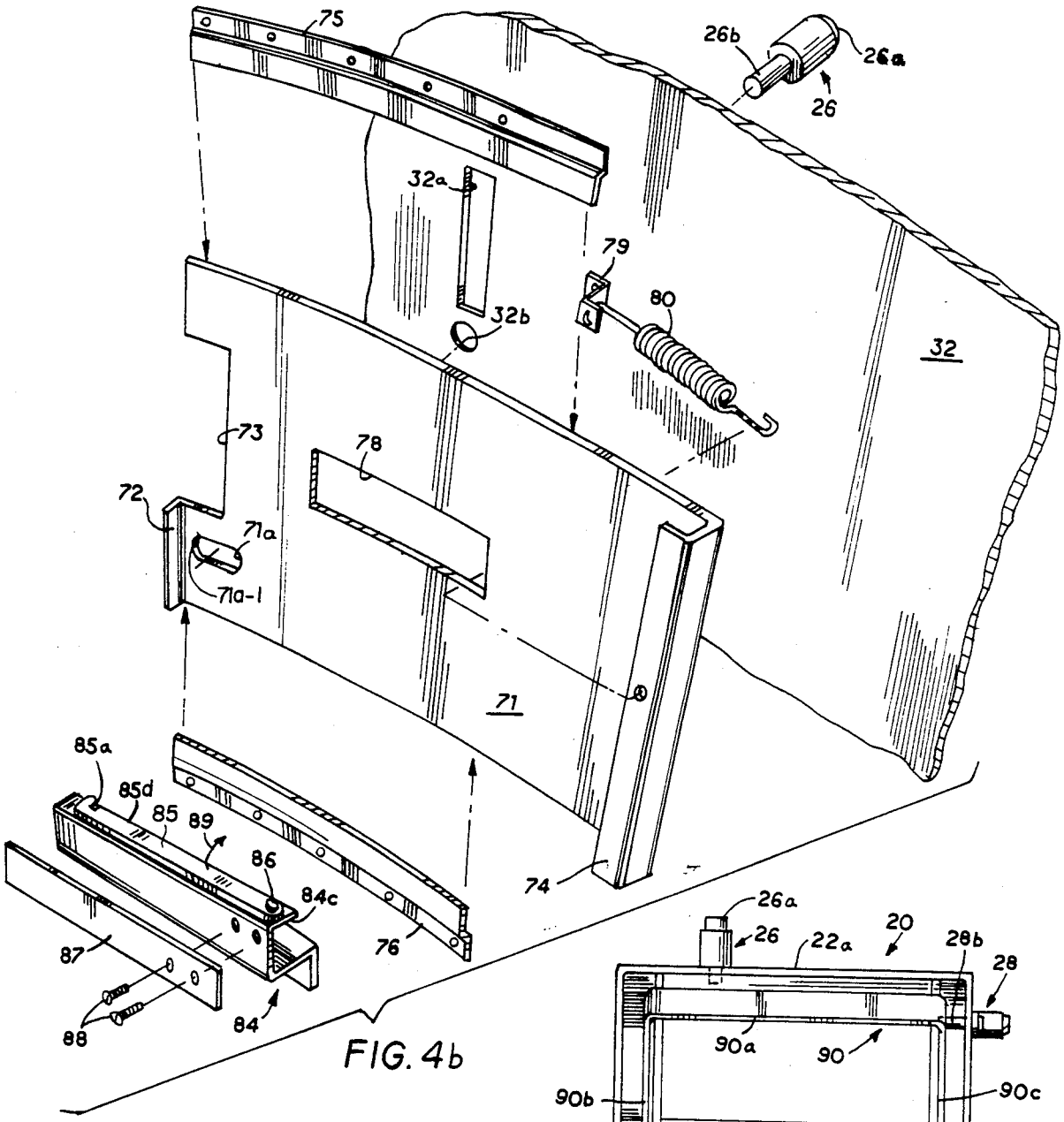

Elongated opening 71a provided in shutter plate 71 adjacent lip 72 cooperates with opening 32b in side wall 32 and with latch arm 85 in a manner to be more fully described hereinbelow:

The shutter assembly 70 operates in the following manner:

Assuming that the drop box 30 has been emptied of its contents and is now ready to be returned to a cooperating sleeve 20, the door at each access opening 34a–34c is unlocked and an operator grasps U-shaped end 74 of a shutter plate in each compartment 48, 50, 52 to move the shutter plate 71 in the direction shown by arrow 82a in FIG. 4a, i.e., in the opposite direction of arrow 82. Thus, each shutter plate 71 is pulled in the direction of arrow 82a against the force of bias spring 80, causing the opening 32a to be unsealed and moving forward lip 72 beneath the rounded end 85c of latch arm 85, lip 72 causing latch arm 85 to be lifted, i.e., rotated in the direction shown by arrow 89a in FIG. 4c. It should be noted that leaf spring 87 is caused to yield from its solid line position to its dotted line position 87', shown in FIG. 4c, due to the lifting of latch arm 85 to the dotted line position 85'.

Figure 4C:
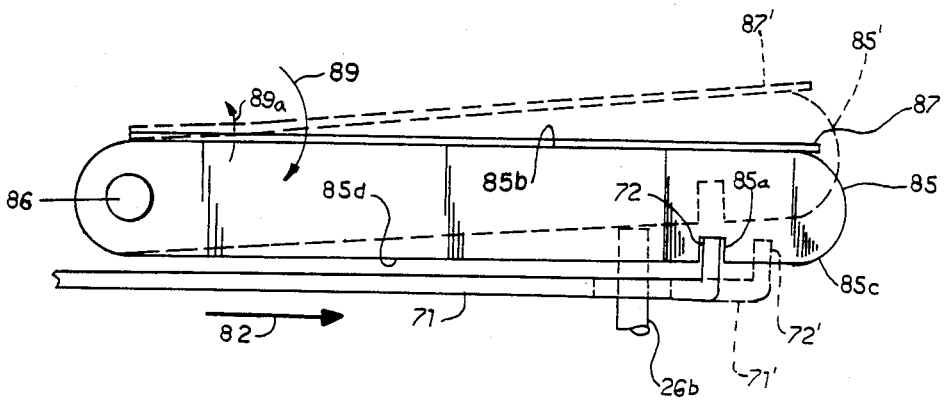

As shutter 71 moves to the left relative to FIG. 4c, as soon as its lip 72 is in alignment with notch 85a, latch arm 85 snaps downwardly from its dotted line position 85' to the solid line position 85 shown in FIG. 4c, capturing lip 72 within notch 85a. In this position, the notched portion 73 of shutter plate 71 is arranged to one side of insertion opening 32a, unsealing this opening.

The shutter plate 71 of each shutter assembly 70 is manipulated in a similar fashion to unseal the insertion openings of all three compartments 48, 50 and 52. The doors 35, 37, 39 are then closed and locked.

The drop box 30 is then inserted into sleeve 20 in the manner previously described and handle 90 is locked by means of lock mechanism 28 in the manner previously described.

Also, as was previously described, indicia 92, 92a and 92b is utilized in cooperation with indicia 29a and 29b to place the insertion slot 32a of the first shift compartment beneath the common insertion slot 22f of sleeve 22.

It should further be noted that when shutter plate 71 is in the latched position, i.e. when its lip 72 is captured by latch arm notch 85a, elongated opening 71a is aligned with its associated circular opening in cylindrical side wall 32 of drop box 30. For example, considering FIG. 4b, elongated opening 71a of shutter plate 71 provided in compartment 48 is in alignment with circular opening 32b in side wall 32. With the cooperating indicia 92a, 92b and 29a, 29b co-aligned, pin 26b of pushbutton lock 26 has its longitudinal axis in alignment with opening 32b in side wall 32 and elongated opening 71a in shutter plate 71. When these members are co-aligned, the pushbutton 26a of pushbutton lock 26 is pressed downwardly moving pin 26b through openings 32a and 71a causing the free end of pin 26b to engage the edge 85d of latch arm 85. As pushbutton 26a is pressed downwardly, pin 26b causes latch arm 85 to move from the solid line position toward the dotted line position 85'. Pin 26b moves a distance sufficient to cause notch 85a to clear lip 72 whereupon spring 80 urges shutter plate 71 in a direction shown by arrow 82 in FIGS. 4a and 4c, thus placing latch arm notch 85a out of alignment with lip 72. Shutter 71 is prevented from moving further in the direction shown by arrow 82 because of the blocking engagement of pin 26b which abuts against end 71a-1 of elongated opening 71. Thus, although the shutter plate 71 is unlatched from latch arm 85, shutter plate 71 is prevented from moving in the direction shown by arrow 82 through a distance sufficient to close and seal the insertion opening 32a of compartment 32. The amount of movement thus experienced by shutter plate 71 during the unlatching operation is controlled by the position and length of opening 71a in shutter plate 71.

Pin 26b also engages opening 32b and prevents drop box 30 from experiencing any rotation, thereby enabling paper currency to be inserted into the first shift compartment 48 (for example). Typically, this is accomplished by placing one or more bills over common insertion opening 94a in table 94 (see FIG. 1a) and pressing the bills into the three co-aligned openings 94a, 22f and 32a with a slender pusher member, to insert the paper currency into compartment 48. The shape of each compartment 48, 50, 52, coupled with its orientation when in the operative position assures that, as the left-hand end of compartment 48 fills, the paper currency will be urged toward the right to make better use of the entire compartment. Thus, even though the volume of compartment 48 may be somewhat smaller than the volume of a conventional drop box of elongated rectangular parallelepiped shape, the unique shape of each drop box compartment 48, 50 and 52, makes more efficient use of the entire compartment interior for containing and storing paper currency.

When the first shift or period is completed, a key is placed in the key opening 26c of pushbutton lock 26 which is a conventional lock, and operates in such a manner that when the key is turned, typically through a one-quarter turn, the locking mechanism is unlatched, causing a spring (not shown) in the lock to move pushbutton 26a and pin 26b to their upper positions, causing pin 26b to be abruptly lifted out of elongated opening 71a in shutter plate 71, as well as being removed from opening 32b in side wall 32.

As soon as the pin 26b is clear of opening 71a, since lip 72, which is in the dotted line position 72', is displaced from notch 85a (see FIG. 4c), shutter plate 71 is free to be rapidly urged in the direction shown by arrow 82 by spring 80 causing the portion of shutter plate 71 behind elongated notch 73 to close and seal opening 34a. Thus, the contents of compartment 48 are sealed and it is not possible to move shutter plate 71 from the exterior of the drop box 30 due to the fact that upon moving to the sealing position, shutter plate opening 71a is displaced from the opening 32b in cylindrical side wall 32, sufficient to prevent the shutter from being moved to the unsealed position by attempted insertion of a sharp instrument or tool. Thus, compartment 48 is protected from any unauthorized entry.

The first shift compartment having been closed and sealed in the manner described upon completion of the first shift, drop box 30 may be rotated to place the insertion opening of the second shift in alignment with the common insertion opening 22f of sleeve 20, and the common insertion opening 94a of table 94. The operation may thus be substantially repeated in a manner similar to that described above in that the indicia identifying the second shift and which, in the preferred embodiment, is displaced 120° about cylindrical surface 32, is brought into co-alignment with cooperating indicia 29a, 29b, and the pushbutton 26a of pushbutton lock 26 is pressed in to release the latch assembly for the second shift compartment and to "cock" the shutter plate 71 in the manner similar to that previously described, thereby maintaining and locking the second shift compartment in the operative position, keeping in mind that the lock 26 is in the locked position when button 26a is pressed downwardly to maintain the second shift compartment in the operative position for the length of the second shift, and for at least as long as pushbutton lock 26 remains locked.

Upon termination of the second shift, the shutter assembly for the second shift compartment is moved to the sealed position by unlocking pushbutton lock 26 and thereafter the third shift compartment is brought into the operative position and maintained in this position by locking pushbutton lock 26 in the same manner as was previously described in connection with the first and second shift compartments.

When all three shifts have been completed, and lock 26 has been unlocked, drop box 30 may be removed simply by unblocking pushbutton lock 28 causing pin 28b to be removed from the opening 91 in handle arm 90b. The drop box 30 may then be simply removed by grasping the yoke portion 90a of handle 90 and pulling the drop box out of sleeve 20 through opening 24. The ends 66a, 66b of drop box pin 66 slide along the supporting guide rails 21, 23, until the drop box is clear of sleeve 20, at which time the drop box 30 may be simply and readily transported to a suitable remote location simply by carrying the drop box by handle 90.

The use of multi-compartment drop box 30 reduces the number of operations required to change the drop box on a daily basis. For example, in applications where it is desired to accurately ascertain the money taken in during the three eight-hour periods, the drop box 30 need be inserted only once every twenty-four hour period, as compared with conventional drop boxes which require removal and replacement every eight hours or three times per day. In addition, the retrieval and counting of the contents need be done only once a day, i.e, upon the removal of the drop box from its cooperating sleeve, reducing the attendent costs and activities.

Although the present invention describes a drop box 30 having three compartments, it should be understood that it is well within the scope of the present invention to provide a drop box having fewer compartments or a greater number of compartments if desired, to meet a particular application.

It should also be understood that the drop box, instead of having a cylindrical side wall shape, may be modified to have a polygonal shape.

Figure 6:
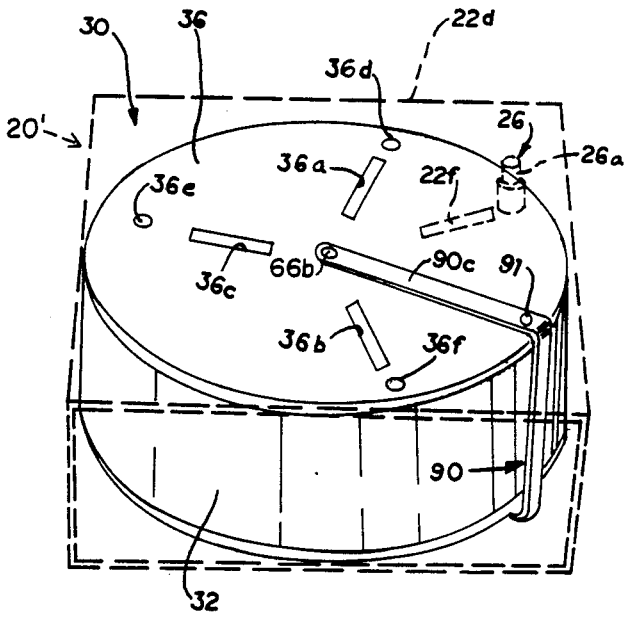
FIG. 6 shows a perspective view of another embodiment of the present invention.

As another alternative, the drop box assembly and its cooperating sleeve may be oriented so that the drop box center pin 66 is coincident with an imaginary vertical axis. In this alternative embodiment, as shown for example in FIG. 6, the insertion openings are moved from cylindrical side wall 32 to one of the side walls such as, for example, side wall 36. Thus, the insertion openings 36a through 36c may be brought into alignment with the insertion opening 22f now located in sleeve side wall 22d. The sleeve 20' is rotated through an angle of 90° relative to the orientation of sleeve 20 shown in FIG. 1. Sleeve 20' may be provided with a pair of guides (not shown) along the interior surfaces of the top and bottom walls to guide the pin 66. A stop may be provided for limiting the penetration depth of the drop box 30 in the sleeve 20'. The guides 25, 27, shown in FIG. 1b, may be employed in the sleeve 20', and arranged along the top and bottom walls of sleeve 20' to facilitate alignment of handle 90. The operation of the drop box 30 is otherwise substantially similar to the drop box embodiment described in connection with FIGS. 1 through 5.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

We claim:

1. A multi-compartment container for receiving and storing currency and the like comprising:

a hollow container rotatable about its central axis;

divider means for dividing the container into a plurality of compartments;

said container having a plurality of access openings each for gaining access to an associated compartment;

a plurality of plates, each being arranged in a compartment, each movably mounted relative to said container for releasably sealing an associated one of said access openings;

locking means for releasably locking each plate in the closed position;

a plurality of insertion slots in said container each associated with one of said compartments;

a hollow housing for removably receiving said container and having a common insertion slot;

means for rotatably supporting said container in said housing for selectively aligning one of said insertion slots with said common insertion slot;

a plurality of detent receiving means on said container each associated with one of said compartments; and detent means on said housing movable into engagement with one of said detent receiving means, releasably retaining the insertion slot aligned with said common slot when said detent is in a first position, engaging one of said detent receiving means and for releasing said container to rotate in said housing when said detent means is in a second position displaced from said container.

2. The apparatus of claim 1, further comprising shutter means in each compartment normally biased to a first position to seal its associated insertion slot and movable to a second position to unseal its associated interior slot;

releasable latch means in each compartment for latching its associated shutter means in its second position.

3. The apparatus of claim 2, wherein said latch means includes movable means normally urged toward latching engagement with said shutter means and being displaced from said shutter means when said detent means engages said detent receiving means.

4. The apparatus of claim 2, wherein each of said shutter means comprisess a:

slidable shutter member;

guide means along the interior wall of the compartment for guiding said shutter member;

bias means normally urging said shutter member in a first direction to seal the associated compartment insertion slot;

said shutter member having a projection;

said latch means engaging said projection when said shutter member is displaced from the compartment insertion opening for restraining the shutter member from movement.

5. The apparatus of claim 4, wherein said detent receiving means comprises a positioning opening in said container adjacent to said insertion opening;

said detent means including a pin insertable into said positioning opening.

6. The apparatus of claim 5, wherein said shutter means further includes an elongated opening substantially aligned with said positioning opening when said shutter means is in said latched position;

said detent means pin being movable into said positioning opening and said elongated opening to displace said latch means from said shutter means and thereby release said shutter means from said latch means;

said detent means holding said shutter means displaced from said insertion opening until said detent means is removed from said elongated opening.

7. The apparatus of claim 6, wherein said detent means comprises a pushbutton lock including said movable pin and a depressable pushbutton for moving said pin into said positioning opening and elongated opening when said pushbutton is depressed;

said pushbutton lock being locked when said pushbutton is depressed.

8. The apparatus of claim 7, wherein said pushbutton type lock includes a lock mechanism, which is unlocked when a matching key is inserted into said lock to release said movable pin, said pushbutton lock including bias means to move said movable pin out of said positioning opening when said lock mechanism is unlocked.

9. The apparatus of claim 1, further comprising handle means movably mounted to said container to facilitate carrying of said container and insertion and removal of said container from said sleeve.

10. The apparatus of claim 9, further comprising locking means on said housing;

said handle means having pin receiving means;

said locking means including a pin movable into said pin receiving means when in a first locked position and displaceable from said pin receiving means when in a second unlocked position;

said handle means and locking means cooperating to prevent removal of said container from said housing while permitting said container to be freely moved within said housing to align each access slot with said common slot.

11. The apparatus of claim 9, wherein said handle means comprises a U-shaped handle member, the free end of said handle member being swingable relative to said container.

12. The apparatus of claim 11, wherein one arm of said U-shaped handle member is provided with an opening;

locking means on said housing including a movable pin insertable into said handle opening for preventing removal of said container from said housing.

13. The apparatus of claim 1, wherein said housing is open at one end to facilitate insertion and removal of said container.

14. The apparatus of claim 1, wherein said housing is mounted to the underside of a table;

said table having an insertion opening aligned with the common insertion opening of said housing;

said table also having an opening aligned with and receiving said detent means to facilitate manipulation of said detent means.

15. The apparatus of claim 1, wherein said container comprises a hollow cylindrical shell having substantially flat parallel ends;

pin means co-axial with the longitudinal axis of said cylindrical shell;

guide means in said housing for supporting said pin means and limiting the depth of entry of said shell into said housing.

16. The apparatus of claim 15, wherein said guide means maintains said pin means in a horizontal alignment;

said insertion openings being arranged at spaced intervals about the cylindrical surface of said shell;

the common insertion opening for said housing being arranged along the top surface thereof for selective alignment with each of said insertion openings.

17. The apparatus of claim 15, wherein said housing is a sleeve having a substantially rectangular parallelepiped shape and having one open vertical side for receiving said shell.

18. The apparatus of claim 17, further comprising a substantially U-shaped handle having its free ends joined to said pin means and being rotatable relative to said shell.

19. The apparatus of claim 18, further comprising lock means arranged in a vertical side wall of said housing adjacent said open vertical side;

an opening being provided in one arm of said handle for receiving a pin provided in said lock means and movable into said handle opening when said lock means is locked to lock said shell in said sleeve, while permitting said shell to freely rotate about said pin means.

20. The apparatus of claim 15, wherein said divider means includes thin divider plates for dividing the container interior into a plurality of compartments of uniform shape and size.

21. The apparatus of claim 20, wherein said movably mounted plates comprise doors hingedly coupled to said container for sealing the access openings, said access openings being arranged in one of the ends of said container for gaining access to an associated one of said plurality of compartments.

22. The apparatus of claim 21, wherein each of said doors further includes lock means for locking each door in its sealed position.

23. The apparatus of claim 21, wherein each of said doors comprises first and second lock means for locking each door in its sealed position, each of said first and second lock means having a different key.

24. The apparatus of claim 20, wherein each compartment further comprises a shutter plate;

guide plates mounted along the interior of the cylindrical wall of said shell for guiding said shutter plate along a predetermined path;

first bias means normally urging said shutter plate in a first direction to seal said insertion opening;

a latch assembly mounted to the interior surface of the cylindrical wall of said shell and having a swingable latch arm, the free end of said latch arm having a notch;

second bias means normally urging said latch arm toward said shutter plate;

said shutter plate having a projection latched into said notch when the shutter plate is displaced from said insertion opening.

25. The apparatus of claim 24 wherein said detent means is mounted on the top surface of said housing and including a pin insertable through an elongated opening in said shutter plate for engaging and displacing said latch arm from said shutter plate projection, said pin and said elongated opening preventing said shutter plate from sealing said insertion opening.

26. The apparatus of claim 25, wherein said detent means is releasable to move said pin out of the elongated opening in said shutter plate to enable said shutter plate to be moved by said first bias means to seal said insertion opening.

27. The apparatus of claim 20, wherein said compartments have substantially pie-shaped, hollow interior regions.

* * * * *